United States Patent [19]

Davis

[11] 3,990,205

[45] Nov. 9, 1976

[54] MOVABLE PARTITION WALL

[75] Inventor: Donald A. Davis, Winchester, Mass.

[73] Assignee: Interflex Systems Inc., Arlington, Mass.

[22] Filed: June 20, 1975

[21] Appl. No.: 588,837

[52] U.S. Cl. ..... 52/241; 52/272; 52/481; 52/486

[51] Int. Cl.[2] ..... E04B 2/82

[58] Field of Search ..... 52/241, 233, 272, 479, 52/238, 483, 239, 484, 593, 486, 293, 481, 264

[56] References Cited

UNITED STATES PATENTS

| | | | |
|---|---|---|---|
| 3,093,218 | 6/1963 | Peterson | 52/241 |
| 3,465,487 | 9/1969 | Fatosme et al. | 52/241 |
| 3,487,598 | 1/1970 | Lopina | 52/481 X |
| 3,503,166 | 3/1970 | Nakazawa et al. | 52/241 X |
| 3,570,200 | 3/1971 | Ritner | 52/241 X |
| 3,608,266 | 9/1971 | Satkin et al. | 52/241 X |
| 3,707,060 | 12/1972 | Jansen, Jr. | 52/241 |
| 3,753,328 | 8/1973 | Papsco | 52/241 |
| 3,755,979 | 9/1973 | Pantazi | 52/204 |
| 3,766,696 | 10/1973 | Totoonchie | 52/241 |
| 3,861,103 | 1/1975 | Rasmussen | 52/241 |

FOREIGN PATENTS OR APPLICATIONS

| | | | |
|---|---|---|---|
| 244,548 | 1/1966 | Austria | 52/241 |
| 1,178,632 | 5/1959 | France | 52/238 |

*Primary Examiner*—Price C. Faw, Jr.
*Assistant Examiner*—Leslie A. Braun
*Attorney, Agent, or Firm*—Donald D. Jeffery

[57] ABSTRACT

A demountable partition assembly comprising a ceiling runner rigidly attached to an upper supporting surface and stabilizer means suspended from said ceiling runner, the stabilizer means receiving and providing lateral support to the upper portion of wall panels hung on the opposed sides of the stabilizer means. The partition assembly is supported at the bottom by support members which permit leveling of the members to be parallel to the ceiling runner, with the bottom surface of the walls being formed with grooves for engagement by tongues formed on finish base members attached to said support members.

5 Claims, 3 Drawing Figures

FIG. 1
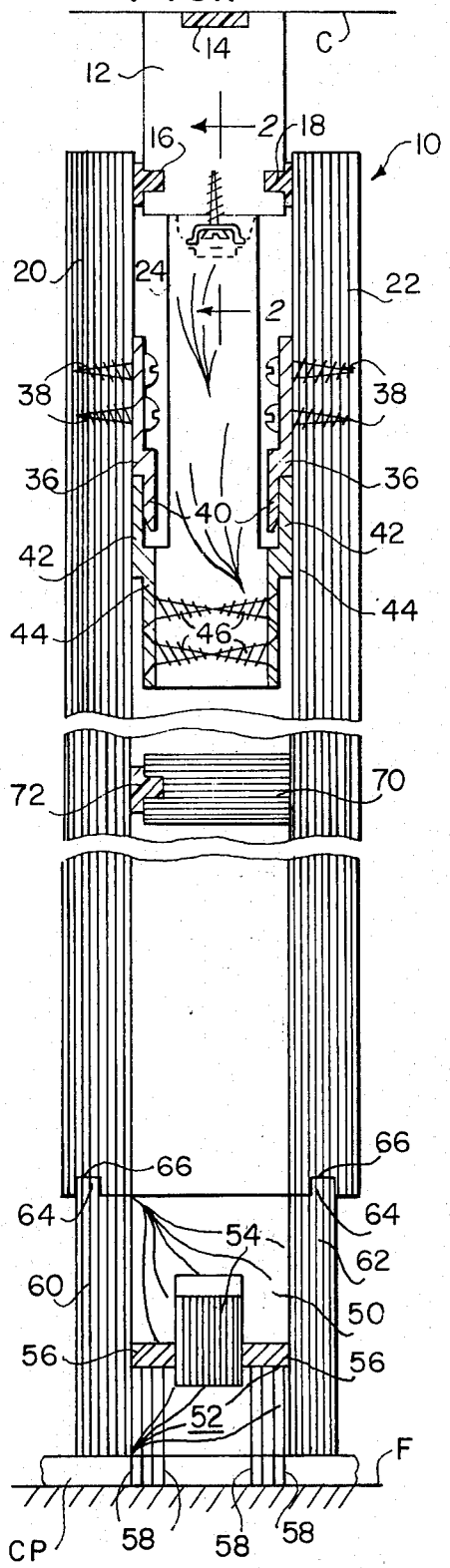
FIG. 3
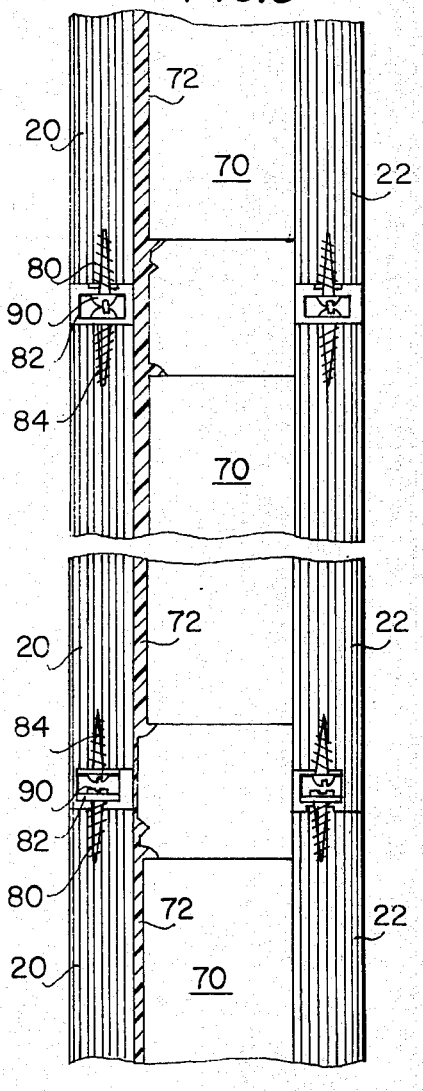
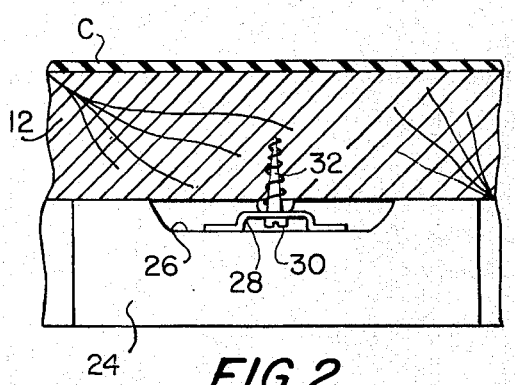
FIG. 2

MOVABLE PARTITION WALL

BACKGROUND OF THE INVENTION

The present invention relates as indicated to a movable partition wall, and relates more particularly to improvements in the partition assembly disclosed and claimed in U.S. Pat. No. 3,755,979, granted Sept. 4, 1973, to Spiros G. Pantazi, and entitled "Demountable Partition Assembly".

The partition assembly disclosed in the aforementioned patent meets the general desired objectives of providing a partition which can be quickly and easily assembled and disassembled between the floor and ceiling of a room and which is designed to minimize heat and sound transmission through the partition assembly. A further advantage of the patented design is to permit the wall panels which form part of the partition to be effectively mounted between support members positioned at the floor and ceiling without requiring the use of tools. The panels and support members are constructed and arranged so that each panel when properly aligned with the support members can be simply dropped in place, with no permanent connection or fastening being required to firmly support the wall panels. The same applies to horizontally adjacent wall panels which can be interconnected without the use of tools. The construction thus permits the wall panels to be easily assembled and disassembled when it is desired to reconstruct the partition at a different location in the room or elsewhere as desired.

Although generally satisfactory for the purpose intended, the patented design has certain manufacturing and operational disadvantages. The construction of the partition assembly is principally of wood materials and the dimension tolerances in manufacture of the partition assembly are quite critical, being in certain instances approximately 1/64 of an inch. In addition, the bottom support members for the partition are secured to the floor in spaced relation thereby not providing the desired sound dampening characteristics at the lower region of the partition. The spaced bottom support members also adversely affect the strength and stability of the partition assembly.

SUMMARY OF THE INVENTION

A primary object of the present invention is to provide a movable partition wall which can be quickly and easily assembled and disassembled between the floor and ceiling of a room and which possesses improved sound dampening strength and stability characteristics. In accordance with the invention, the support structure for the partition wall positioned at the floor extends continuously the length of the partition wall thereby providing improved sound dampening in such region as well as enhancing the strength and stability of the partition wall at the bottom thereof.

A further object of the invention is to provide a partition wall which is simple in construction, economical to manufacture, and easy to install or remove following installation. The wall panels and supporting members are constructed and interconnected in such a manner that close tolerances are not required thereby achieving the indicated economy in the manufacturing process.

A still further object of the present invention is to provide a partition wall in which the bottom support member is constructed to include downwardly depending nails or the like which engage the floor for supporting the wall and which space the main sections of the bottom support member from the supporting surface. By virtue of such construction, in instances where the movable partition wall is to be installed in rooms which are carpeted, the main sections of the bottom support members are positioned at or slightly above the top surface of the carpeting thereby not destroying or damaging the same when the partition wall is installed. The nails or the like do penetrate through the carpeting for engagement with the floor, but the nails do not damage the carpet thereby leaving the carpet relatively intact when and if the partition wall is entirely removed or relocated.

These and other objects of the invention will appear as the following description proceeds in particular reference to the application drawing.

BRIEF DESCRIPTION OF THE APPLICATION DRAWING

In the application drawing,

FIG. 1 is a vertical sectional view, partially fragmented, of the movable partition wall constructed in accordance with the present invention;

FIG. 2 is a sectional view taken on line 2—2 of FIG. 1, and

FIG. 3 is a top plan view partially fragmented, showing the preferred manner of interconnecting adjacently disposed wall panels.

DETAILED DESCRIPTION OF THE PREFERRED EMBODIMENTS

Referring now in more detail to the application drawing, in which like parts are indicated by like reference numerals, and initially to FIG. 1, the movable partition wall constructed in accordance with the present invention is generally indicated at 10 and is normally installed between the ceiling C and the floor F of a room which is intended to be subdivided by such partition. A ceiling runner 12, which preferably runs continuously longitudinally of the partition wall, is secured to the ceiling by mounting bolts or the like, with the top, ceiling-engaging surface of the runner being formed with an opening for receiving a gasket 14 which serves to seal the interface between the partition wall and the ceiling and to reduce the sound transmission through the partition wall at such interface. The transmission of noise through the upper region of the partition wall is further reduced by the provision of gaskets 16 and 18 which are mounted in openings therefor in the opposed faces of the runner 12, which gaskets are engaged by the wall panels 20 and 22 when the latter are suspended on the support members as will be hereinafter described. It will be noted that the gaskets 14, 16 and 18 can be eliminated where solid contact can be established at the interfaces of the described members.

Secured to the ceiling runner 12 is an upper stabilizer 24 which is preferably approximately 6 inches in length, referring to the longitudinal dimension of the wall, with similar stabilizers being positioned at spaced intervals to provide the necessary support for the wall panels 20 and 22. The manner in which the stabilizer 24 is mounted on the ceiling runner 12 is shown in detail in FIG. 2. The top surface of the stabilizer is recessed as shown at 26 to receive a fastening member 28 which can be bolted or otherwise secured to the stabilizer in the recess. The top section of the fastener is formed with a slot for receiving the head 30 of a shoulder screw 32, with the intermediate section of the fastener being provided with an opening through which the head 30 can extend for locating the head 30 below the top section of the fastener. The depth of the recess 26, the construction of the fastener 28 and the position of the shoulder screw 32 is such that the top surface of the stabilizer 24 is closely adjacent the bottom surface of the ceiling runner 12 when the stabilizer is supported thereon as shown in FIG. 2.

The wall panels 20 and 22 can be constructed of any suitable material, for example wood or plastic, or combinations of these materials, depending upon the use environment. Metal cleats commonly designated at 36 are secured to the inner surfaces of the panels by screws commonly indicated at 38. As noted, the bottom sections 40 of the cleats are laterally offset to receive terminal sections 42 of stabilizer cleats commonly designated at 44 which are secured to the stabilizer adjacent the bottom thereof by mounting screws commonly designated at 46. The stabilizer cleats 44 are likewise preferably constructed of metal, and the interfitting of the panel cleats with the stabilizer cleats provides a stable interconnection for laterally supporting the upper region of the wall panels from the ceiling C through the stabilizers 24.

The wall panels 20 and 22 are supported from the floor F by means of a leveling shoe 50 and a floor runner 52. These members are adjustably interconnected by means of a knurled spline connector 54 that extends into openings provided therefor in the shoe and the runner. The diameter of the openings in these members is slightly less than the outside diameter of the connector 54 whereby the knurled surface thereof is forced into the walls which define the openings to provide a fairly rigid connection, while at the same time permitting vertical adjustment of the shoe parallel to the ceiling runner to provide exacting spacing between the ceiling runner and the shoe.

Leveling shims commonly designated at 56 are interposed if needed between the leveling shoe 50 and the floor runner 52 so as to position the top surface of the leveling shoe at the desired elevation from the floor F. A plurality of leveling shoes 50 are provided in longitudinally spaced relation on the floor runner, which is preferably continuous, whereby the leveling shoes can be leveled by the shims 56 to provide a planar, level surface for supporting the bottoms of the wall panels. The continuous runner 52 provides constant support for the entire wall panel assembly thereby enhancing the stability and strength of the wall partition, while at the same time providing a higher degree of soundproofing in the bottom region of the wall.

In the form shown, a plurality of nails commonly designated at 58 extend downwardly through the floor runner 52, which is preferably of wood material, as are the leveling shoes 50, with the leading edges of the nails 58 extending substantially below the bottom of the runner for engagement with the floor F. This arrangement is preferably employed when the movable partition wall is to be mounted on floors that are carpeted, with the carpeting being designated CP. In this manner the partition wall is supported from the floor F through the nails 58 and the bottom supporting members thereby causing minimal damage to the carpet, an important feature if the partition wall is subsequently relocated so as to expose the carpet CP. The penetration of the nails 58 through the carpet CP does not cause significant damage to the carpet. The floor runner 52 is positioned at the upper surface of the carpet when the nails 58 are employed so as not to damage or mat down the carpet due to the weight of the partition wall. The nails 58 prevent lateral shifting of the partition.

Attached to the leveling shoe 50 and floor runner 52 by nails or other type fasteners are base members 60 and 62 the height of which generally corresponds with the combined height of the leveling shoes, shims and floor runner. The base members 60 preferably extend the full longitudinal dimensions of the partition wall and each member if formed with a tongue 64 at the upper surface thereof. The tongues 64 are adapted to extend into grooves 66 formed in the bottom surface of the panels 20 and 22 thereby to provide a tongue-and-groove interconnection between the wall panels and the base members 60 and 62, with the loading of the partition wall being transferred from the base members to the leveling shoe and floor runner to which they are secured. The tongue-and-groove arrangement provides a higher degree of stability, and the relatively tight interconnection between the wall panels and the base members, together with the continuous floor runner 52, significantly enhance the soundproofing characteristics of the partition wall in the bottom region thereof.

In order to stabilize the vertically intermediate portion of the partition wall, an intermediate stabilizer 70 is provided which may be attached to the wall panel 22 and which has mounted in the opposite end thereof a sealing gasket 72 which is adapted to engage the adjacent surface of the wall panel 20 when these panels are suspended as shown in FIG. 1.

The installation of the partition wall described above should be apparent from such description. To briefly summarize, the ceiling runner 12 is installed and the upper stabilizing members 24 mounted thereon in longitudinally spaced relation. The continuous floor runner 52 is then laid down and the leveling shoes 50 interconnected to the floor runner at spaced intervals, with the leveling shoes being shimmed to level the upper surface of the shoes where the floor F is uneven. The base members 60 and 62 are thereafter secured to the leveling shoes and floor runner. The wall panels 20 and 22 are thereafter positioned in general alignment with their supporting structures and dropped in place so that the panel cleats 36 are received behind the cleat sections 42 of the upper stabilizers. During the controlled dropping of the wall panels 20 and 22 the bottoms of the panels are guided so as to establish the tongue-and-groove connection between the bottom surfaces of the wall panels and the base members 60 and 62. The panels are actually supported by the tongue-and-groove arrangement, with the engagement of the panel and stabilizer cleats serving to properly space and stabilize the upper mounting of the panels to the upper stabilizer and ceiling runner thereby effectively transferring the weight of the partition wall to the floor F. When the panels are suspended as described, the sealing gasket 72 of the intermediate stabilizer 70 engages the adjacent surface of the wall 20 and the upper gaskets 16 and 18 mounted to the ceiling runner 12 engage the adjacent surfaces of the panels and are compressed thereby, thereby greatly reducing the sound transmission through the partition wall in such regions.

To disassemble the partition wall 10 for partition removal or relocation, the wall panels 20 and 22 are simply lifted thereby disengaging the grooves 66 from the tongues 64 and clearing the panel cleats 36 from engagement with the stabilizer cleats 42. The ceiling runner 12 and upper stabilizers 24 can then be removed as can be the floor runner 52 and the leveling shoes 50. Since the bottom supporting members are not connected to the floor F but only supported thereon by the nails 58, these members can simply be lifted from the floor for reuse elsewhere.

The wall panels 20 and 22 are preferably dimensioned in four foot widths, similar to decorative plywood, and in order to provide a continuous partition wall made up of several adjacently disposed wall panels, the panels can be interconnected in the manner shown in FIG. 3. The interconnection is generally the same as shown in FIG. 2 for interconnecting the upper stabilizer 24 to the ceiling runner 12, with at least two shoulder screws 80 being mounted in vertically spaced relation on the edge of the upper and lowermost panels 20 as shown in the plan view orientation of FIG. 3. The intermediate panel 20 as shown in FIG. 3 has mounted at both side edges thereof clip fasteners 82 similar in construction to the clip fastener 28 shown in FIG. 2. Openings are formed in the side edges of the intermediate panel to accommodate the clip fasteners 82, with the latter being mounted in such openings by means of mounting screws 84. The clip fasteners 82 are slotted as previously described to receive the head portions 90 of the shoulder screws whereby laterally adjacent panels can be joined by engaging the heads 90 of the shoulder screws 80 beneath the slotted sections of the fasteners for interconnecting the adjacently disposed panels. It will be noted that the openings formed in the intermediate panel for receiving the clip fasteners 82 are recessed relative to the exterior surface of the panels thereby providing a continuous wall surface when adjacent panels are connected as shown in FIG. 3. In lieu of the FIG. 3 interconnection of adjacent panels, the adjoining edges of adjacent panels can be shiplapped or tongue-and-grooved for more economical manufacture.

Although FIGS. 1–3 illustrate a partition wall comprised only of panels, it will be understood that the wall can be modified to incorporate windows or doors, in the same general manner as shown in U.S. Pat. No. 3,755,979.

It will thus be seen that the present invention provides a partition assembly which fully meets the stated objectives of the invention. The partition can be quickly and easily assembled or disassembled and the construction thereof provides a relatively stable partition which is particularly characterized by its improved noise dampening characteristics. The provision of a continuous runner at the bottom of the partition wall serves to strengthen and stabilize the partition while at the same time substantially reducing the sound transmission through the wall in such region. The partition wall is simple in design and economical to manufacture.

It will be apparent to those skilled in the art that minor variations can be made in the partition wall illustrated and described without, however, departing from the concepts of the invention. For example, additional intermediate stabilizers can be provided to further rigidify the partition wall in the intermediate regions thereof as well as reducing the noise transmission through such regions. Also, in the event the partition wall is to be supported directly on the floor rather than through a layer of carpet, the floor runner can be removably secured to the floor by tape or the like to prevent lateral shifting of the partition when installed. If the partition is later removed, the tape can also be removed without damage to the floor surface. Also, other methods of connection can be employed for interfitting the panels to the bottom support, for example, dowels, shiplapping, or similar methods so long as the weight of the partition is transferred to the support members.

I claim:

1. A demountable partition assembly comprising a. a ceiling runner rigidly attached to the upper supporting surface for the partition assembly, b. stabilizer means suspended from said ceiling runner, said stabilizer means being constructed and arranged to receive, align and provide lateral support to the upper portion of wall panels hung on the opposed sides of said stabilizer means, c. a pair of wall panels at either side of said partition assembly and forming the exposed wall surfaces thereof, each of said wall panels carrying on its upper, inner surfaces mounting means for cooperative, demountable engagement with said stabilizer means for aligning and supporting said panels relatively adjacent their upper ends, said panels being formed with grooves in the bottom surface thereof, and d. separate floor runner means positioned on the supporting surface for the partition, and nail means extending downwardly through said runner means and terminating below said runner means so as to space the bottom of said runner means from the supporting surface for the partition, the elevation of said runner means from the supporting surface permitting the partition assembly to be installed over carpeting without significant damage thereto, e. supporting shoe means positioned on said floor runner means, and means interposed between said floor runner means and said supporting shoe means for interconnecting and leveling said supporting shoe means relative to said floor runner means, and f. finish base members secured to and covering said supporting shoe means and said floor runner means at both sides thereof, said base members being formed with tongues in the upper ends thereof for engaging said grooves in said panels, said stabilizer means in cooperation with said floor runner means and said supporting shoe means serving as the sole means for supporting said panels, with such supporting arrangement permitting mounting and demounting of said wall panels without the use of special tools for partition relocation as desired.

2. The partition assembly of claim 1 wherein said stabilizer means is suspended from said ceiling runner by means of a disconnectable fastener assembly which permits installation and demounting of said stabilizer means from said ceiling runner without the use of special tools.

3. The assembly of claim 2 wherein said fastener assembly comprises a fastener clip mounted in an opening provided therefor in the upper surface of said stabilizer means, and a shoulder screw mounted on the bottom wall of said ceiling runner and extending outwardly therefrom, said fastening clip being constructed and arranged to receive and retain said shoulder screw thereby effecting the disconnectable mounting.

4. The partition assembly of claim 1 wherein said mounting means for mounting said wall panels on said stabilizer means comprises metal cleat members formed on the inner surfaces of said panels and cooperative cleat members mounted on said stabilizer means, the lower ends of said cleat members mounted on said wall panels being laterally offset for engagement behind similarly offset portions of said cleat members mounted on said stabilizer means, the interfitting of said cleat members serving to guide and provide lateral support for the wall panels in the upper regions thereof.

5. The partition assembly of claim 1 wherein said floor runner and said leveling shoe are interconnected by means of a knurled spline connector which is rigidly secured to said leveling shoe and said floor runner in openings provided therefor in these members.

* * * * *